United States Patent [19]

Dobosi et al.

[11] Patent Number: 4,847,597

[45] Date of Patent: Jul. 11, 1989

[54] MEDICINE BOTTLE

[76] Inventors: Laszlo J. Dobosi, 4317 Markwood La., Fairfax, Va. 22033; Sandor Szima, 101 S. Whiting St, #1014, Alexandria, Va. 22034

[21] Appl. No.: 154,329

[22] Filed: Feb. 10, 1988

[51] Int. Cl.[4] ..... G08B 21/00

[52] U.S. Cl. ..... 340/571; 206/459; 206/807; 215/100 R; 215/201; 340/568; 340/540

[58] Field of Search ..... 340/571, 572, 573, 309.4, 340/568, 540; 116/72; 215/228, 230, 365, 201, 203, 100 R; 206/459, 807

[56] References Cited

U.S. PATENT DOCUMENTS

| | | | |
|---|---|---|---|
| 3,952,295 | 4/1976 | Wisada et al. | 206/459 |
| 4,335,377 | 6/1982 | Bostic | 340/573 |
| 4,617,558 | 10/1986 | Gin | 340/571 |
| 4,688,023 | 8/1987 | McGill et al. | 340/545 |
| 4,711,368 | 12/1987 | Simons | 340/572 |

*Primary Examiner*—Glen R. Swann, III

*Attorney, Agent, or Firm*—Larson and Taylor

[57] ABSTRACT

A medicine container for sounding an audible alarm when the cap for the container is partially removed. The manipulation of the cap relative to the medicine bottle initiates the operation of an electrical audible alarm mounted on the cap.

6 Claims, 1 Drawing Sheet

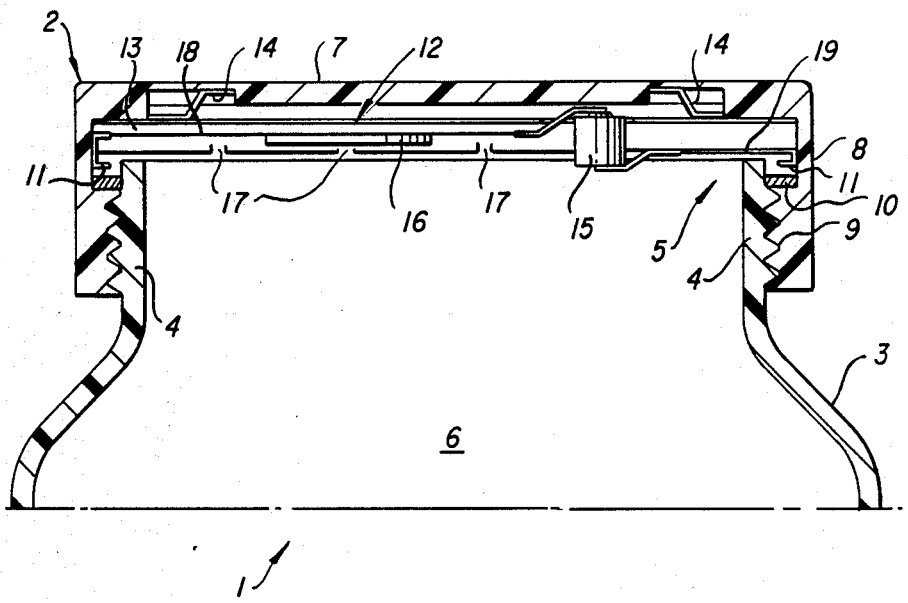
2
13
18
14
7
12
14
19
8
11
11
10
9
17
16
17
15
5
4
4
3
6
1

MEDICINE BOTTLE

BACKGROUND OF THE INVENTION

The present invention relates to a medicine bottle and more particularly to a medicine bottle having an alarm to indicate the removal of the bottle cap from the medicine bottle.

DESCRIPTION OF THE PRIOR ART

It is known in the prior art to utilize some form of device to increase the difficulty of removing the cap from a medicine bottle. The need for such means is based on the fact that children can be injured or killed by the accidental ingestion of medicine. Moreover, even adults can be subject to the dangers of accidentally opening and using medicines which are not intended. Furthermore, in some instances, unauthorized access has been made to medicines on drugstore counters wherein poisons are substituted for safe medicine substances. In view of these problems, it is not unusual to find that medicine is sold in containers having both tamper-proof and child-proof features to the cap. For example, shrink-wrapped plastic can be applied over the exterior of the medicine bottle and its cap to secure them together and to indicate any premature opening. The threaded engagement between the cap and the medicine bottle can be designed so that the cap cannot be removed without first taking certain manually difficult manipulative steps before the cap can be freed from the bottle itself.

SUMMARY OF THE INVENTION

Accordingly, one object of the present invention is to provide an improved medicine container for sounding an audible alarm when the cap for said container is partially removed. It is another object of the present invention to use the manipulation of the cap relative to the medicine bottle to initiate the operation of an electrical audible alarm mounted on the cap.

According to another aspect of the present invention, we provide a medicine container comprising a bottle which defines an opening having a closure means removably secured over the opening. Within the closure means, an audible alarm generating means is mounted and means are provided connected to the bottle and to the closure means for activating the audible generating means to sound an alarm when the closure means is partially removed from the bottle.

According to still a further aspect of the present invention, the audible alarm generating means comprises a base, a miniature battery and miniature electronic sound generating device.

According to another aspect of the present invention, we provide a closure adapted for use on medicine container, the closure being a cap means having an internally threaded skirt, a base mounted inside of the cap, a miniature battery, an audible sound generating alarm device mounted on the base, and means for sensing when the closure is removed relative to a contaner so that the alarm device is activated.

It should be understood that other objects and advantages of the present invention will be readily appreciated by reference to the following detailed description when considered in connection with the accompanying drawing.

DESCRIPTION OF THE DRAWING

The single FIGURE of drawing is a schematic showing of one embodiment of the present invention wherein a medicine container for sounding an audible alarm due to cap removal is illustrated.

DESCRIPTION OF THE PREFERRED EMBODIMENT

The drawing graphically depicts one embodiment of the container according to the present invention. The medicine container 1 for sounding an audible alarm when the cap 2 is partially removed is generally shown in the drawing. The container comprises a bottle 3 with an externally threaded neck 4 which defines an opening 5 for removal of the bottle's contents from area 6. The cap means 2 has a circular planar end 7, a skirt 8 with internal threads 9 for engagement with said externally threaded neck. 4. Also, the cap means 2 has an electrically conductive ring 10 mounted on the inside of the skirt 8. As seen in the single figure of drawings, this can be conveniently done on a ledge formed by an enlargement of the skirt. Two electrical contact means 11 and an audible alarm generating means 12 are movably mounted within the cap means on a base 13.

Furthermore, spring means 14 are provided for biasing the base 13 toward the bottle opening. As shown in the drawing, contact means 11 and the ring 10 are constructed and arranged so that when the cap 2 is secured on the bottle, as seen in the single figure, then the contact means and ring are vertically spaced apart as shown. However, when the cap 2 is untightened and sufficiently moved away from the secured position, each contact means 11 moves against the ring 10 under the downward force of spring means 14 to complete an electrical circuit to activate the audible alarm generating means 12.

It should be appreciated that the audible alarm generating means has a base 13, a miniature battery 15 and an electronic sound generating device 16 mounted on the base with sound openings 17 facing the bottle. The battery can be of any commercially available make and the sound generating device can be of any known type which is small yet generates a sufficiently audible alarm sound. It should be appreciated that the conductive ring 10 is a split ring so that it does not extend entirely around the inside of the skirt of the cap. Thus, ring 10 provides a conductor between the electrical contacts 11 to complete a circuit including the battery 15, sound generator 16, and conductors 18 and 19.

While a preferred embodiment of the present invention has been illustrated and described, it will be apparent to those skilled in the art that modifications can be made within the scope of the invention which is defined in the appended claims. Accordingly, the foregoing embodiment is to be considered illustrative only, rather than restricting the invention, and those modifications which come within the meaning and range of equivalency of the claims are to be included herein.

We claim:

1. A medicine container comprising:

a bottle defining an opening adapted for removal of medicine from said bottle;

a closure means removably secured over said opening;

an audible alarm generating means mounted within said closure means;

means mounted on said closure means for activating said audible alarm generating means to sound the alarm when said closure means is at least partially removed from said opening.

2. The invention of claim 1, wherein said audible alarm generating means comprises a base, a miniature battery and an electronic sound generating device all mounted on said base.

3. The invention of claim 2, wherein said closure means is in the shape of a cylindrical cap having a circular planar end and an internal thread means for engagement with external thread means on said bottle, and said base and its attached audible alarm generating means is movably mounted adjacent to the circular planar end.

4. The invention of claim 3, wherein said means for activating said audible alarm comprises:

an internal shoulder on said cap;

an electrical conducting split ring mounted on said shoulder;

electrically conducting contacts mounted on said base;

spring means for biasing said audible alarm generating device toward said bottle opening;

said contacts and said ring being constructed and arranged so that when said cap is secured to said bottle, they are spaced apart, and when said closure means is at least partially untightened from said bottle, said contacts are moved by said spring means against said split ring to complete an electrical circuit to activate said audible alarm generating device.

5. A medicine container for sounding an audible alarm when the cap means for the container is partially removed, said container comprising:

a bottle with an externally threaded neck defining an opening adapted to allow removal of medicine from the inside of the bottle;

a cap means having a circular planar end, a skirt with internal threads for engagement with said externally threaded neck, and an electrically conductive split ring mounted on the inside of said skirt;

electrical contact means and an audible alarm generating means on a base movably mounted within said cap means;

spring means for biasing said base toward said bottle opening;

said contact means and said split ring being constructed and arranged so that, when said cap means is secured on said bottle, they are spaced apart, and when said cap means is at least partially untightened from said bottle, said contact means moves against said split ring to complete an electrical circuit to activate said audible alarm generating means.

6. A closure adapted for use on medicine containers, said closure comprising a cap means having an internally threaded skirt, a base mounted inside of said cap means, a miniature battery and audible sound generating alarm device mounted on said base, and means for sensing when said closure is removed relative to a container to activate said audible sound generating alarm device.

* * * * *